US009682303B2

(12) United States Patent
Vilhelmsen

(10) Patent No.: US 9,682,303 B2
(45) Date of Patent: Jun. 20, 2017

(54) GOLF SWING SELF EVALUATION KIT AND METHOD

(71) Applicant: Kurt Vilhelmsen, Buckley, WA (US)

(72) Inventor: Kurt Vilhelmsen, Buckley, WA (US)

( * ) Notice: Subject to any disclaimer, the term of this patent is extended or adjusted under 35 U.S.C. 154(b) by 0 days.

(21) Appl. No.: 14/970,954

(22) Filed: Dec. 16, 2015

(65) Prior Publication Data

US 2016/0166911 A1 Jun. 16, 2016

Related U.S. Application Data

(60) Provisional application No. 62/092,661, filed on Dec. 16, 2014.

(51) Int. Cl.
*A63B 69/36* (2006.01)
*A63B 69/00* (2006.01)

(52) U.S. Cl.
CPC ..... *A63B 69/3608* (2013.01); *A63B 69/0059* (2013.01); *A63B 69/3623* (2013.01); *A63B 2225/093* (2013.01)

(58) Field of Classification Search
USPC ..... 473/207–212, 219–225, 257, 266, 267, 473/274, 276, 409
See application file for complete search history.

(56) References Cited

U.S. PATENT DOCUMENTS 1,459,705 A * 6/1923 Bullock ..... A63B 69/3608 473/208
3,013,013 A * 12/1961 Carboni ..... C07D 207/44 548/161
3,178,187 A * 4/1965 Cardwell ..... A63B 69/3608 273/DIG. 17
3,437,339 A * 4/1969 Starck ..... A63B 69/3608 2/195.1
3,729,200 A * 4/1973 Hines ..... A63B 69/3608 2/209.13
5,658,203 A * 8/1997 Shub ..... A63B 69/0059 473/205
6,102,809 A * 8/2000 Nichols ..... A63B 69/3608 473/227
6,217,495 B1 * 4/2001 Yalch ..... A63B 15/00 473/256
D443,328 S * 6/2001 Martin ..... D21/791
6,386,988 B1 * 5/2002 Shearer ..... A63B 21/06 473/220
6,939,245 B1 9/2005 Mullarkey
(Continued)

*Primary Examiner* — Nini Legesse
(74) *Attorney, Agent, or Firm* — Dean A. Craine, P.S.

(57) ABSTRACT

The kit includes an elongated stick designed to extend longitudinally over the golfer's two shoulders and a golf ball elevational tool that includes a clip that attaches to the front edge of the brim on a hat or visor worn by the golfer. Attached to the clip is a length adjustable, string that attaches to a golf ball. The clip attaches to the brim and the length of the string is adjusted so the golf ball hangs freely just above the ground. The elongated stick is placed over the golfer's shoulders and the head and neck are tilted downward towards the ball. The golfer then rotates his or her waist, upper torso, and swings his or her shoulders forward and rearward until the opposite ends of the elongated stick touch or pass the golfer's front mid-line axis without lifting the ball or causing the ball to excessively swing.

1 Claim, 4 Drawing Sheets

(56) References Cited

U.S. PATENT DOCUMENTS

| | | | | |
|---|---|---|---|---|
| 6,991,556 | B2 * | 1/2006 | LaTerra ..... | A63B 69/3608 2/209.13 |
| 7,229,361 | B1 | 6/2007 | Park et al. | |
| 2003/0045368 | A1 | 3/2003 | Farmer et al. | |
| 2004/0106462 | A1 | 6/2004 | Ianazone | |
| 2007/0142119 | A1 | 6/2007 | Popin | |
| 2009/0181788 | A1 * | 7/2009 | O'Connor ..... | A63B 21/0004 473/286 |

* cited by examiner

GOLF SWING SELF EVALUATION KIT AND METHOD

This utility patent application is based upon and claims the filing date benefit of U.S. Provisional patent application (Application No. 62/092,661) filed on Dec. 16, 2014.

Notice is given that this patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

This invention pertains to training tools for golfers that helps a golfer to self monitor and self correct problems with his or her stance, insufficient flexibility, insufficient rotation of his or her waist and upper torso, and excessive movement of the head or neck during a golf swing.

2. Description of the Related Art

It is generally accepted that the concept of a 'perfect swing' for all golfers does not exist. Every golfer must learn a golf swing best suited for his body. Most golfers understand the concepts of using a proper approach, stance, backswing, weight transfers, swing plane, and follow through. However, learning what is the correct movement of the legs, the correct twisting of the waist and shoulders, the correct weight transfer from right to left and then correct weight transfer from left to right for an optimal golf swing is difficult. Once these movements have been identified, they must be practiced so they are automatically used in every golf swing. Other important tasks used in a golf swing, such as hand grips, backswing and forward movement of the club along a swing angle, and elbow angle and elevation in the backswing, etc., must be mastered.

When performing a golf swing, the golfer must stand in a comfortable position with the ball placed at a comfortable distance on the ground in front of the golfer along the body's midline axis. The golfer's feet must face forward, parallel and spaced from the midline axis and separated a distance approximately equal to the width of the golfer's shoulders. The golfer's legs should be straight and slightly bent at the knees and the golfer's weight initially distributed evenly on the balls of both feet. The golfer's waist and upper torso should be sufficiently flexible so the waist may sufficiently twist enabling the shoulders to freely rotate from side to side effortlessly. Ideally, during the back swing and forward swing the clavicles should pass over the body's midline axis. Also, the twisting of the waist and the rotation of the shoulders should be smooth and at a constant rate. Also, the golfer's neck and head should align with the body's midline axis and continuously aim slightly downward towards a golf ball on the ground.

What is needed is a kit and method that enables a golfer to 'feel' a balanced golf swing stance and then identify and self monitor the fundamental sequential movements of his or her legs, waist and shoulders used in a golf swing. As the same time, what is needed is a kit that allows a golfer to be cognizant of and 'feel' how the weight of the body shifts to the rear leg during a backswing and the shifts forward to the front leg simultaneously as the golfer's waist twists and the shoulders rotate.

SUMMARY OF THE INVENTION

The above cited objects are satisfied by the kit and method disclosed described as a golf swing elevation and balance kit that helps a golfer detect improper stance, insufficient flexibility, improper weight shifting, improper rotation of the waist and shoulders, and improper holding of the neck and head in a downward tilted orientation during a golf swing.

The kit includes a flexible elongated stick designed to be positioned perpendicular to the golfer's spine and longitudinally aligned with and extended over the golfer's shoulders and behind the golfer's neck. The elongated stick is sufficiently long so the golfer may extend his or her forearms upward and outward partially over the elongated tick and hold the elongated stick on the shoulders as they are rotated. The golfer then twists his or her waist and upper torso and shoulders in a clockwise and counter-clockwise directions (for a right handed golfer) so the opposite ends of the elongated stick and opposite shoulders move forward and rearward. The golfer gradually twists the waist and rotates the upper torso and repeatedly swings the elongated stick back and until the clavicle on each shoulder and the ends of the elongated stick touch or pass over the golfer's midline axis. When the ends of the elongated stick cross the golfer's midline axis, the golfer's upper torso is considered sufficiently flexible to properly swing a golf club.

The kit also includes a golf ball elevational tool that includes a main clip designed to attach to the front edge of the brim on a hat or visor worn by a golfer. Attached to the clip is a lightweight string that attaches to a regulation size golf ball. During use, the golfer attaches the clip to the brim of the hat or visor and adjusts the length of the string so when the golfer is in a stance for hitting a golf ball on the ground or tee, and the golf ball hangs freely from the brim and positioned ¼ to ½ inch above the ground. The golfer then places the elongated stick horizontally over both shoulders and tilts his neck and head slightly downward so his or her chin and nose point downward and his or her eyes looking at the ball. The golfer then rotates his or her spine causing the shoulders to swing forward and rearward trying not to lift or swing the ball forward or backward or from left to right.

The elongated stick is used not only for stretching the upper torso but also used to teach a golfer to keep the shoulders longitudinally aligned during a golf swing. It also teaches a golfer that the waist and upper torso must be sufficiently flexible to the clavicle on each shoulder passes over the golfer's midline axis during a golf swing. The golf ball elevational tool is used to delineate the golfer's midline axis in front of the golfer and to position the golf ball at its normal location during a golf swing so the golfer stands in a proper position relative to the golf ball and the golfer also continuously looks downward at the golf ball during the golf swing.

Also disclosed is a method for monitoring and developing proper stance, balance, waist and shoulder flexibility and neck position when performing a golf swing, comprising:

a. selecting a flexible, elongated stick or golf club;
b. selecting a golf ball elevational tool that includes a main clip designed to attach to the front edge of a forward extending brim on a hat or visor worn by the golfer, said golf ball elevational tool also includes a length adjustable lightweight string attached at one end to said clip and a regulation size golf ball attached to the end of said string opposite the end attached to the clip;
c. attaching the clip to the brim of the golfer's hand or visor;

d. adjusting the length of said string so the golf ball is positioned just above the ground when the golfer's head and neck are slightly tilted downward when executing a golf swing;

e. placing the elongated stick or golf club over his or her the shoulders and turning the head and neck downward towards the ball; and, f. rotating the elongated stick or golf club and the shoulders until the ends of the stick reach the golfer's front mid-line axis without lifting the ball or causing the ball to swing forward, backward, left or to the right while watching the golf ball.

DESCRIPTION OF THE PREFERRED EMBODIMENT(S)

Referring to the FIGS. 1-4, there is shown a golf swing elevation and balance kit 10 that helps a golfer 80 detect improper stance, improper balance, insufficient flexibility or improper rotation of the waist and improper alignment of the golfer's head 84 and neck during a golf swing.

Figure 1:
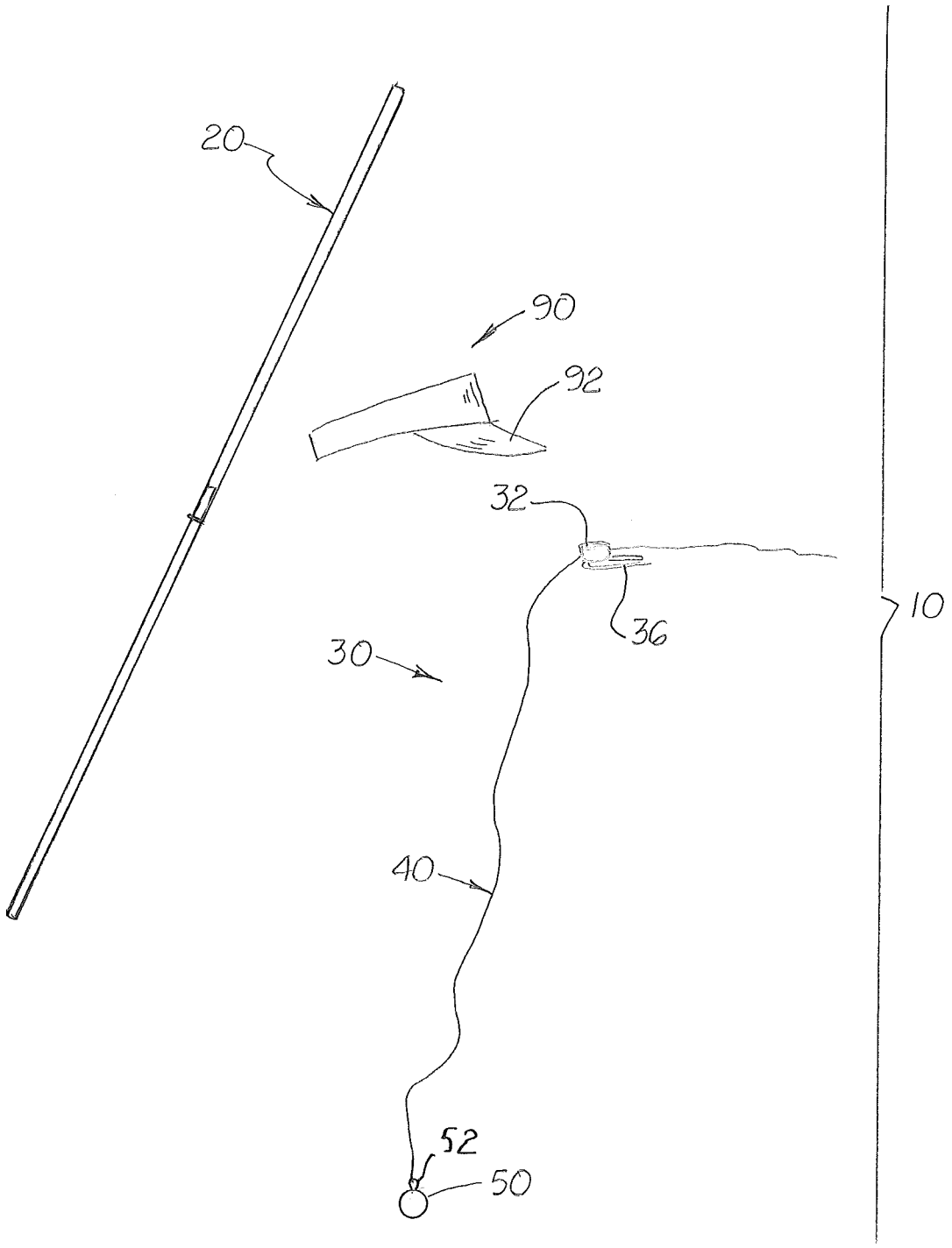
FIG. 1 is an illustration of the golf swing elevation and balance kit.
Figure 2:
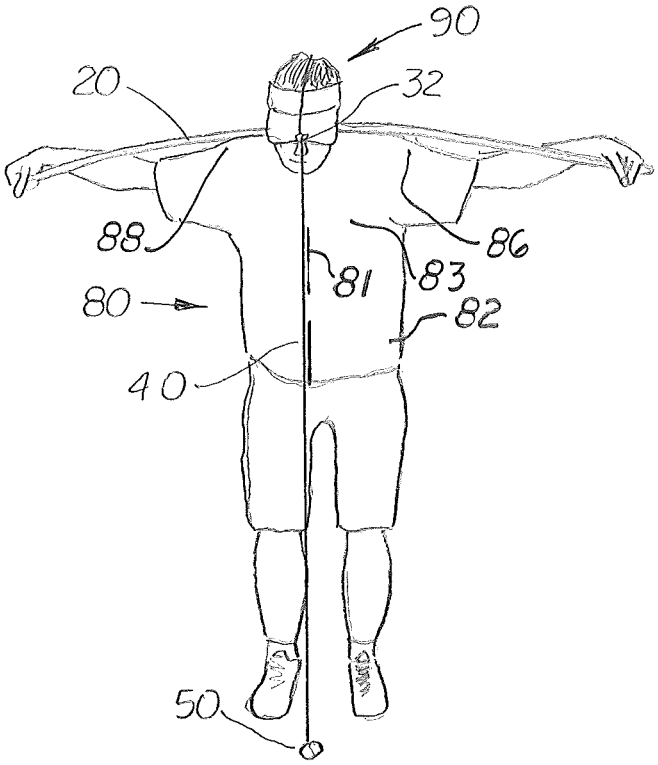
FIG. 2 is an illustration of the golfer with the elongated stick extended over the golfer's shoulder and the golf ball elevated tool attached to the brim of the golfer's visor
Figure 3:
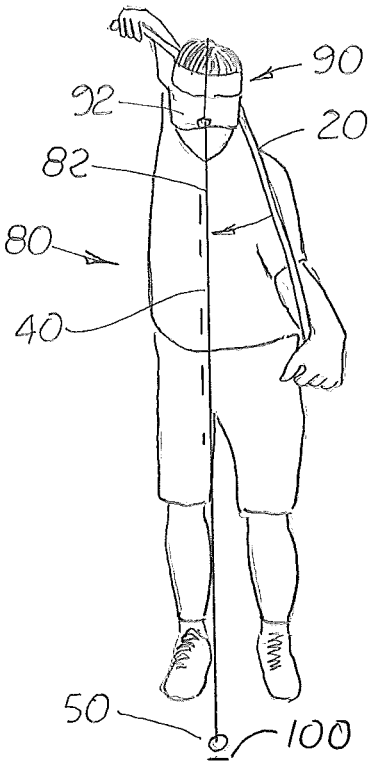
FIG. 3 is an illustration of the golfer as shown in FIG. 2 rotating his waist and shoulders while tilting the neck and head downward and looking downward over the golf ball.
Figure 4:
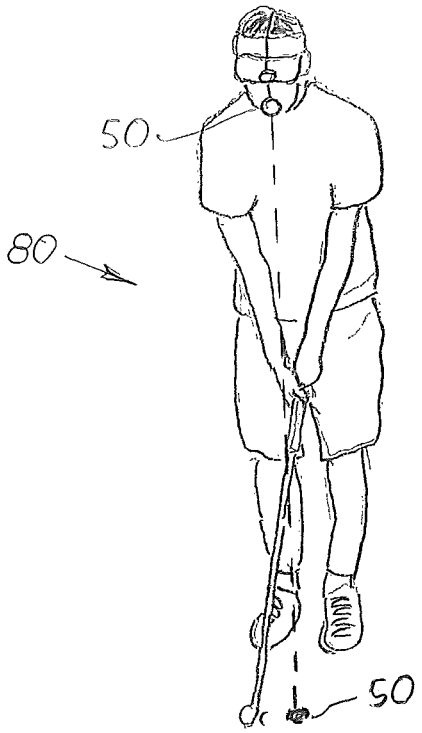
FIG. 4 is an illustration of the golfer in a stance to hit a golf ball.

The kit 10 includes a straight, flexible elongated stick 20 designed to be positioned horizontally over the shoulders 86, 88 and behind the golfer's 80 neck. The elongated stick 20 is evenly aligned over the shoulders 86, and 88 and sufficient in length to allow the golfer 80 to extends both arms 90, 92 outward and extend both forearms around the opposite ends of the elongated stick 20 as shown in FIG. 2. The golfer 80 repeatedly rotates the elongated stick 20 90 degrees in opposite directions causing the waist 82 and upper torso 83 to also rotate so the opposite shoulders 86, 88 and opposite ends of the stick 20 reach or extend over the golfer's midline axis 81. Initially, the golfer 80 may not be able to rotate the elongated stick 90 degrees in both directions. The golfer 80 repeatedly rotates his and her opposite shoulders 86, 88 forward and rearward until the waist 82, the upper torso 83 and shoulders 86, 88 are stretched.

The kit 10 also includes a golf ball elevational tool 30 that includes a main body 32 attached to a clip 36 designed to attach to the front edge of a brim 92 on a visor or hat 90 worn by the golfer 80. Attached to the clip 36 is a lightweight string 40 that attaches to a regulation size golf ball 50. During use, the golfer 80 attaches the clip 36 to the brim 92 of his or her visor or hat 90 and adjusts the length of the string 40 so the golf ball 50 is positioned just above the ground 100. In the preferred embodiment, the string 40 is approximately 84 inches in length. Attached to the golf ball 50 is an eyelet 52 used as a connection point and as a structure for winding up excessive string 40 to shorten the string 40. The golfer 80 then places the elongated stick 20 over the opposite shoulders 86, 88, extends his or her arms 96, 98 under the elongated stick 20 and tilts the neck and head 84 slightly downward to look at the golf ball 50. The golfer 80 then rotates his or her shoulders 86, 88 forward and rearward and the elongated stick 20 without lifting the golf ball 50 or causing the golf ball 50 to swing forward or backward or from side-to-side.

If the golf ball 50 swings excessively forward, rearward or side to side as the shoulders are rotated, such movement may indicate the golfer's stance is improper, that the waist 82 or upper torso 83 may be too rigid or inflexible, that the rotation of the waist 82 is not smooth and continuous, or that the golfer's balance was improper. The golfer 80 continues to rotate the elongated stick 20 and the shoulders 86, 88 and monitor movement of the golf ball 50 until movement of the golf ball is minimized (e.g. no more that 1 inch). The golfer 80 practices the exercises for several days until movement of the golf ball 50 is minimal after the first rotation.

In one embodiment, the elongated stick 20 is a lightweight plastic pipe made of PVC approximately 1 inch thick and 36 to 60 inches in length. In one embodiment, the elongated stick 20 is a fixed length. In another embodiment, the elongated stick 20 is a telescopic structure that collapses into a short tube approximately 24 inches in length and extends 48 inches in length. In another embodiment, the elongated stick 20 is eliminated and golf club is used in its place.

A method for monitoring and developing proper stance, balance, waist and shoulder flexibility and neck position when performing a golf swing, comprising the following steps:

a. selecting a flexible, elongated stick or golf club;

b. selecting a golf ball elevational tool that includes a main clip designed to attach to the front edge of a forward extending brim on a hat or visor worn by the golfer, said golf ball elevational tool also includes a length adjustable lightweight string attached at one end to said clip and a regulation size golf ball attached to the end of said string opposite the end attached to the clip;

c. attaching the clip to the brim of the golfer's hand or visor;

d. adjusting the length of said string so the golf ball is positioned just above the ground when the golfer's head and neck are slightly tilted downward when executing a golf swing;

e. placing the elongated stick or golf club over his or her the shoulders and turning the head and neck downward towards the ball; and, f. rotating the elongated stick or golf club and the shoulders until the ends of the stick reach the golfer's front mid-line axis without lifting the ball or causing the ball to swing forward, backward, left or to the right while watching the golf ball.

In compliance with the statute, the invention described has been described in language more or less specific on structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

I claim:

1. A method for a golfer to practice a golf swing on a support surface, comprising the following steps:

a. selecting a swing elevation and balance kit that includes a straight flexible, elongated stick with opposite distal ends and a golf ball elevational tool that includes a main clip designed to attach to the front edge of a brim on a visor or hat worn by said golfer, a length adjustable, lightweight string attached at one end to said main clip, and a regulation size golf ball attached at an end of said string opposite said end attached to said main clip;

b. attaching said main clip to said brim of said visor or said hat so that string extends along said golfer's front midline axis and adjusting the length of said string so that said golf ball is positioned at a fixed distance in front of said golfer and just above the ground enabling said golf ball to swing side to side;

c. placing said elongated stick over said golfer's shoulders and looking downward at said golf ball; and, d. sufficiently rotating said golfer's waist and shoulders from side to side so that said distal ends of said elongated stick swing and cross said golfer's front mid-line axis denoted by said string and simultaneously holding said visor or said hat in a fixed position so that said golf ball attached to said string does not move vertically, swing forward, swing backward, or swing left or to the right while rotating said waist and shoulders.

* * * * *